United States Patent [19]

Takiguchi et al.

[11] Patent Number: 4,535,895

[45] Date of Patent: Aug. 20, 1985

[54] SORTING DEVICE

[75] Inventors: Kiyoaki Takiguchi, Yokohama; Seigo Takano, Tokyo, both of Japan

[73] Assignee: Computer Services Corporation, Tokyo, Japan

[21] Appl. No.: 470,720

[22] Filed: Feb. 28, 1983

[30] Foreign Application Priority Data

| | | | |
|---|---|---|---|
| Apr. 13, 1982 | [JP] | Japan | 57-61308 |
| Apr. 20, 1982 | [JP] | Japan | 57-66534 |
| Apr. 24, 1982 | [JP] | Japan | 57-69213 |
| Apr. 27, 1982 | [JP] | Japan | 57-70625 |
| May 11, 1982 | [JP] | Japan | 57-79298 |
| May 11, 1982 | [JP] | Japan | 57-79299 |

[51] Int. Cl.[3] ..... B07C 1/10; B07B 13/65

[52] U.S. Cl. ..... 209/683; 209/288; 209/687; 209/910

[58] Field of Search ..... 209/683, 684, 687, 680, 209/659, 910, 244, 284, 286, 288, 370, 294, 372, 406, 44.3, 664

[56] References Cited

U.S. PATENT DOCUMENTS

| | | | |
|---|---|---|---|
| 264,681 | 9/1882 | Fowler | 209/370 |
| 453,185 | 6/1891 | Gschwender | 209/683 |
| 3,709,329 | 1/1973 | Mlodzinski | 209/683 |
| 3,750,884 | 8/1973 | Satake | 209/683 |
| 4,150,750 | 4/1979 | Sawasky | 209/664 |

FOREIGN PATENT DOCUMENTS

| | | | |
|---|---|---|---|
| 949670 | 2/1964 | United Kingdom | 209/683 |

*Primary Examiner*—Robert B. Reeves
*Assistant Examiner*—Donald T. Hajec
*Attorney, Agent, or Firm*—Koda and Androlia

[57] ABSTRACT

A sorting device for sorting out a multiplicity of pieces such as tickets according to their size, comprises a cylindrical sorter drum rotatably mounted in a frame for storing therein pieces having different sizes to be sorted out, means on the sorter drum including openings for passing therethrough pieces of a particular size only; and a motor for rotating the sorter drum about its own axis to cause the pieces of the particular size to be discharged through the openings out of the sorter drum.

6 Claims, 20 Drawing Figures

SORTING DEVICE

BACKGROUND OF THE INVENTION

The present invention relates to a sorting device for sorting out differently sized thin pieces such as tickets, metal pieces, coins, or other tokens according to their size.

Small articles of different sizes can manually be sorted out according to their size, but the manual sorting operation has been time-consuming and subjected to errors. Various automatic sorting mechanisms have heretofore been used for mechanically or electrically classifying and sorting out different kinds of pieces according to their size. Though the known automatic sorters are highly effective to sort out relatively heavy and thick objects such as coins or nuts, the mechanisms fail to divide relatively light and thin pieces into groups according to their size. No sorting device has been developed which is capable of sorting out light and thin articles without suffering from errors. It has therefore been customary practice to resort to manual procedures for sorting out pieces of paper such as tickets, pieces of cloth, or thin pieces of metal.

SUMMARY OF THE INVENTION

It is an object of the present invention to provide a sorting device of a simple structure for sorting out a large number of lightweight and thin pieces of different sizes according to their size.

Another object of the present invention is to provide a sorting device for automatically sorting out differently sized pieces efficiently in a short period of time.

According to the present invention, there is provided a sorting device for sorting out a multiplicity of pieces such as tickets according to their size, the device comprising a cylindrical sorter drum rotatably mounted in a frame for storing therein pieces having different sizes to be sorted out, means on the sorter drum including openings for passing therethrough pieces of a particular size only; and means for rotating the sorter drum about its own axis to cause the pieces of the particular size to be discharged through the openings out of the sorter drum.

The above and other objects, features and advantages of the present invention will become more apparent from the following description when taken in conjunction with the accompanying drawings in which preferred embodiments of the present invention are shown by way of illustrative example.

DETAILED DESCRIPTION

The present invention is particularly useful when embodied in a device as shown for sorting out rectangular pieces of paper such as tickets according to their size. However, the sorting device can also be used to sort out other thin, lightweight pieces or articles such as coins, pieces of cloth, or the like according to their size.

Figure 1:
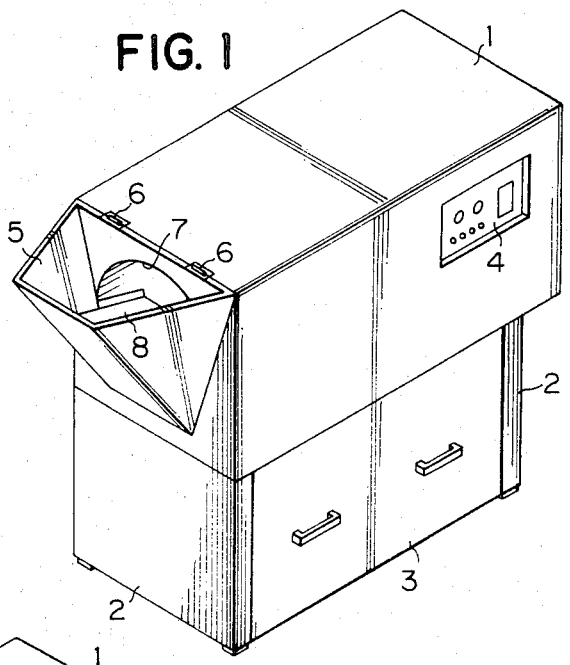
FIG. 1 is a perspective view of a sorting device according to the present invention.
Figure 2:
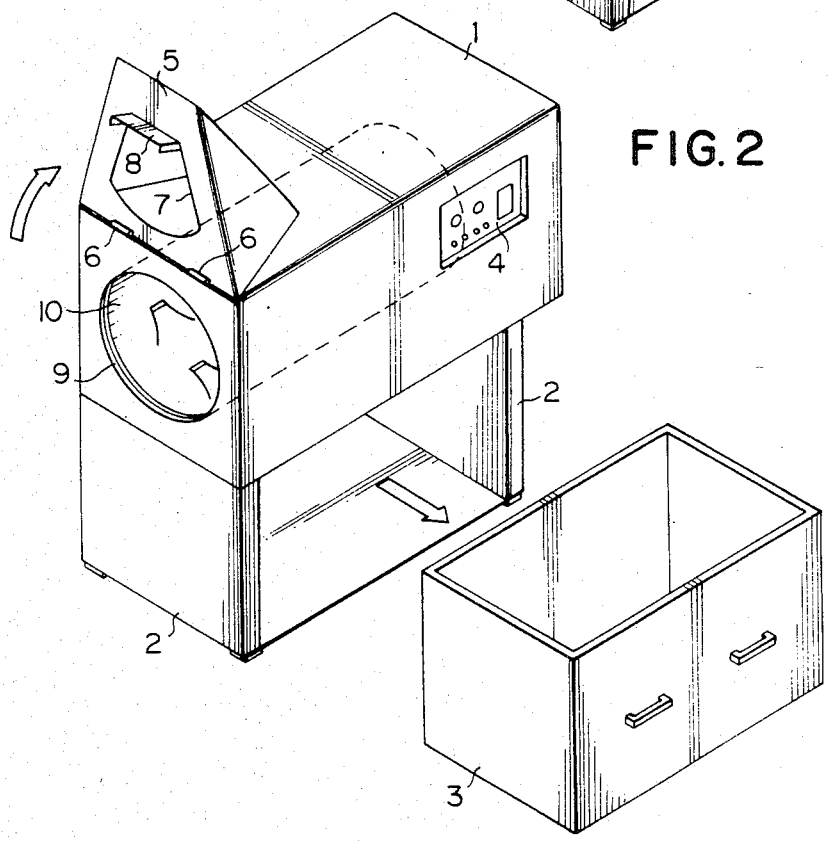
FIG. 2 is a perspective view of the sorting device shown in FIG. 1 with a collector box pulled out and a ticket charger lifted.

As illustrated in FIGS. 1 and 2, a sorting device comprises a body or frame 1 from which depend a pair of legs 2 spaced laterally from each other, and a collector box 3 opening upwardly and removably interposed between the legs 2. The frame 1 has on a side thereof a control panel 4 having switches and lamps. A ticket charger 5 is pivotably connected by hinges 6 to an upper edge of the frame 1, and is of a triangle cross section. The ticket charger 5 has an upper trapezoidal opening and a charging hole 7 in its side which normally faces the frame 1. The ticket charger 5 also includes a slanted chute 8 extending through the charging hole 7 into the frame 1 when the ticket charger 5 is in the ticket charging position as shown in FIG. 1. As shown in FIG. 2, the collector box 3 can laterally be slid out, and the ticket charger 5 can be angularly moved to an upper position in which the ticket charger 5 is placed on an upper surface of the frame 1. The frame 1 has a circular opening 9 in the side thereof on which the ticket charger 5 is mounted. A sorter drum 10 is housed in the frame 1 and has an open end substantially in registry with the circular opening 9. When the ticket charger 5 is in the ticket charging position, the circular opening 9 is covered with the ticket charger 5 with the chute 8 of the ticket charger 5 extending through the circular opening 9 into the sorter drum 10. When the ticket charger 5 is lifted as shown in FIG. 2, the circular opening 9 is exposed to provide access into the sorter drum 10 therethrough.

Figure 3:
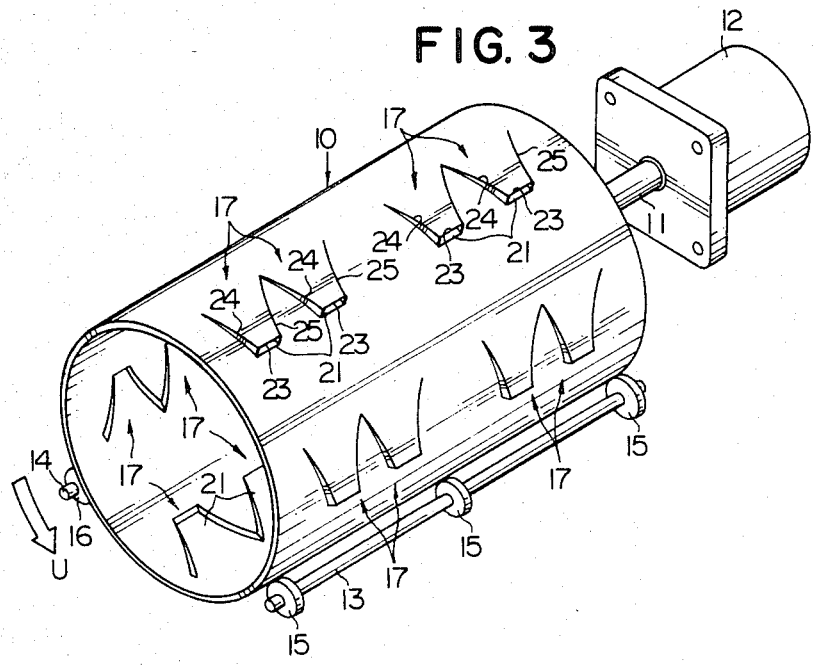
FIG. 3 is a perspective view of a sorter drum mounted in the sorting device shown in FIG. 1.
Figure 4:
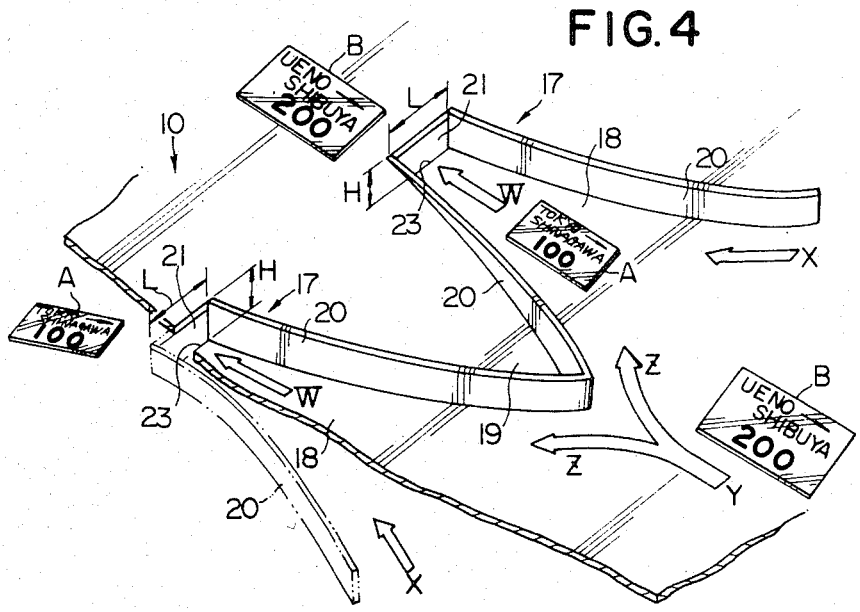
FIG. 4 is an enlarged fragmentary perspective view of the sorter drum shown in FIG. 3.

As illustrated in FIGS. 3 and 4, the sorter drum 10 has a hollow cylindrical wall of thin metal sheet having one end open (lefthand as shown) and the other end closed off to which is concentrically connected a drive shaft 11 coupled to a motor 12. The sorter drum 10 has a central axis extending horizontally, and is rotatably supported by a pair of support shafts 13, 14 laterally spaced from each other and extending axially parallel to and below the sorter drum 10, the support shafts 13, 14 having rollers 15, 16 held in rolling engagement with the cylindrical wall of the sorter drum 10.

The sorter drum 10 has a plurality of parallel rows of tapered tongues 17 sheared off the cylindrical wall radially outwardly thereof and extending circumferentially of the cylindrical wall, the rows of the tapered tongues 17 extending axially of the sorter drum 10 and circumferentially spaced from adjacent ones. In the illustrated embodiment, the tapered tongues 17 in each row are four in number. Each of the tapered tongues 17 includes an end edge 23 and a pair of parabolically converging side edges 24, 25 extending from the cylindrical wall to the end edge 23. The end edge 23 is displaced radially outwardly from the cylindrical wall to define therewith an opening 21 extending radially outwardly and having a height H and a length L that are selected to allow passage of tickets of a particular size through the opening 21. Accordingly, the tapered tongues 17 terminate respectively in the openings 21 and are progressively narrower toward the openings 21 to provide tapered slide surfaces 18. In each row of the substantially flat tapered tongues, the adjacent ones are paired and the paired tapered tongues define therebetween a bullet-shaped separator 19 as shown in FIG. 4. A guide strip 20 extends along each of the parabolic side edges 24, 25, and is secured to both the side edge and the cylindrical wall, as best illustrated in FIG. 4. The guide strips 20 as paired on both sides of each slide surface 18 thus provide a chute for guiding tickets to be sorted out toward the the opening 21. More specifically, one end of each guide strip 20 is located at the distal end of the slide surface 18 and serves to define the opening 21, while the other end is positioned at the opposite end of the slide surface 18 which blends into the cylindrical wall of the sorter drum 10, and protrudes radially inwardly of the sorter drum 10. The guide strips 20 disposed one on each side of the separator 19 between the paired tapered tongues 17 are joined at their ends remote from the openings 21 and substantially assume a V shape surrounding the separator 19.

Operation of the sorting device thus constructed is as follows: Where two kinds of tickets A, B of different sizes (FIG. 4) dependent on printed fares are to be sorted out, the sorting device is assembled as shown in FIG. 1, and a mixture of tickets A, B is introduced through the upper opening of the ticket charger 5 down the chute 8 into the sorter drum 10 in the frame 1. Then, the start switch on the control panel 4 is turned on to start the motor 12 which rotates the drive shaft 11 to rotate the sorter drum 10 in the direction of the arrow U (FIG. 3), in which the pointed ends of the separators 19 lead the openings 21. The mixed tickets A, B are collected at a lower portion in the sorter drum 10 as they slide and tumble therein, and are gathered by the guide strips 20 in the directions of the arrows X, Y, Z onto the slide surfaces 18 between the opposite guide strips 20. The tickets A of a smaller size are permitted to flow in the direction of the arrow W through the openings 21 out of the sorter drum 10 as the openings 21 are dimensioned to allow the tickets A to pass longitudinally therethrough. The tickets A as discharged through the openings 21 are received in the collector box 3. The tickets B, which are larger than the tickets A, are large enough to be rejected by the openings 21, and either get caught by the guide strips 20 before reaching the openings 21 or are forced to flow over the openings 21, so that the tickets B will remain in the sorter drum 10 without being discharged. When the sorting operation has been finished, the motor 12 is de-energized by a timer switch, for example, to stop the sorter drum 10, and the collector box 3 is pulled out to transfer the collected tickets A into another storage box. The ticket charger 5 is then turned upwardly about the hinges 6 to uncover the circular opening 9, through which the tickets B can be picked up from the sorter drum 10 by hand or a vacuum suction device for separate storage.

The sorting device can thus sort out differently sized tickets automatically in a relatively short period of time. While the sorter drum 10 is in rotation, the separators 19 and the guide strips 20 can guide the tickets effectively onto the slide surfaces 18 leading to the openings 21 so that the tickets will forcibly be sorted out at an increased rate.

Figure 5:
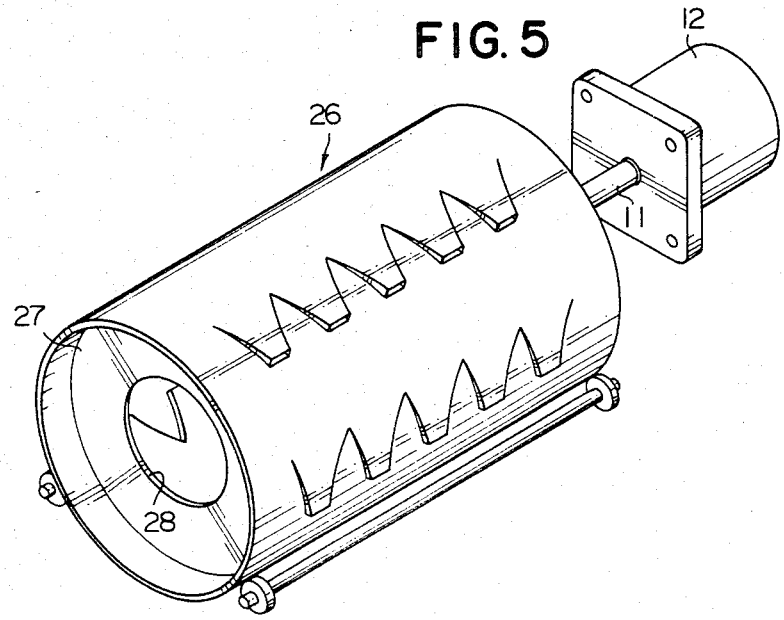
FIGS. 5 and 6 are perspective views of sorter drums according to modifications.

FIG. 5 shows a modified sorter drum 26 having an annular plate 27 mounted in an open end of the sorter drum 26 at a position slightly displaced off the end of the sorter drum 26, the annular plate 27 having a central circular hole 28. Where the sorter drum 26 is mounted in the frame 1 as illustrated in FIG. 1, the chute 8 of the ticket charger 5 as it is in the ticket charging position has a distal end projecting into the central hole 28 in the annular plate 27. The annular plate 27 serves to prevent tickets contained in the sorter drum 26 from accidentally going out through the open end of the sorter drum 26 while the latter is at rest or in rotation.

Figure 6:
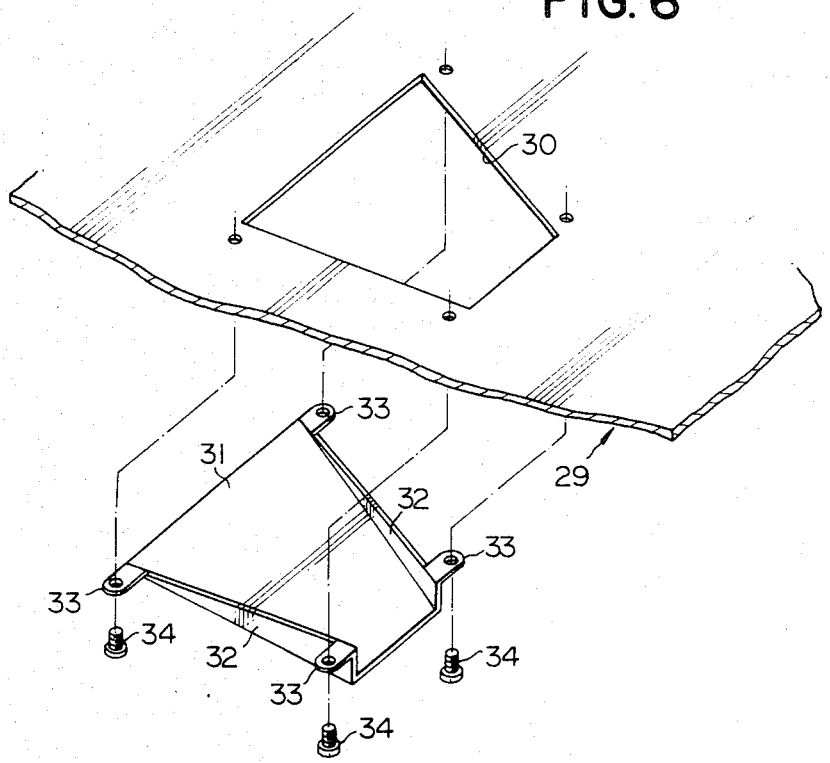

Another modified sorter drum 29 is illustrated in FIG. 6. The sorter drum 29 has a plurality of trapezoidal holes 30 (only one shown) each of which is covered with a separate trapezoidal tongue 31 that is substantially complementary in shape to the trapezoidal hole 30. The tongue 31 has a pair of tapered side walls 32, 32 each including a pair of mounting tabs 33, 33 at its ends. The tongue 31 is fastened to the sorter drum 29 on its outer circumferential surface in covering relation to the hole 30 by screws 34 extending through the tabs 33, respectively, threadedly into the sorter drum 29. Each of the side walls 32, 32 has its width progressively larger from the wider end of the tongue 31 toward the shorter end thereof, so that when the tongue 31 is mounted on the sorter drum 29, they jointly form an opening for passage therethrough of tickets of a particular size.

Figure 7:
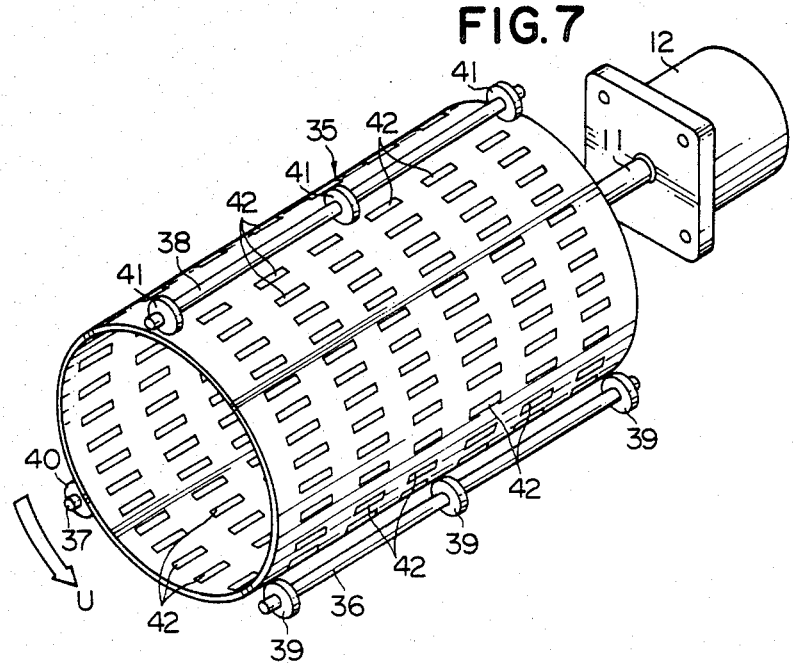
FIG. 7 is a perspective view of a sorter drum according to another embodiment.
Figure 8:
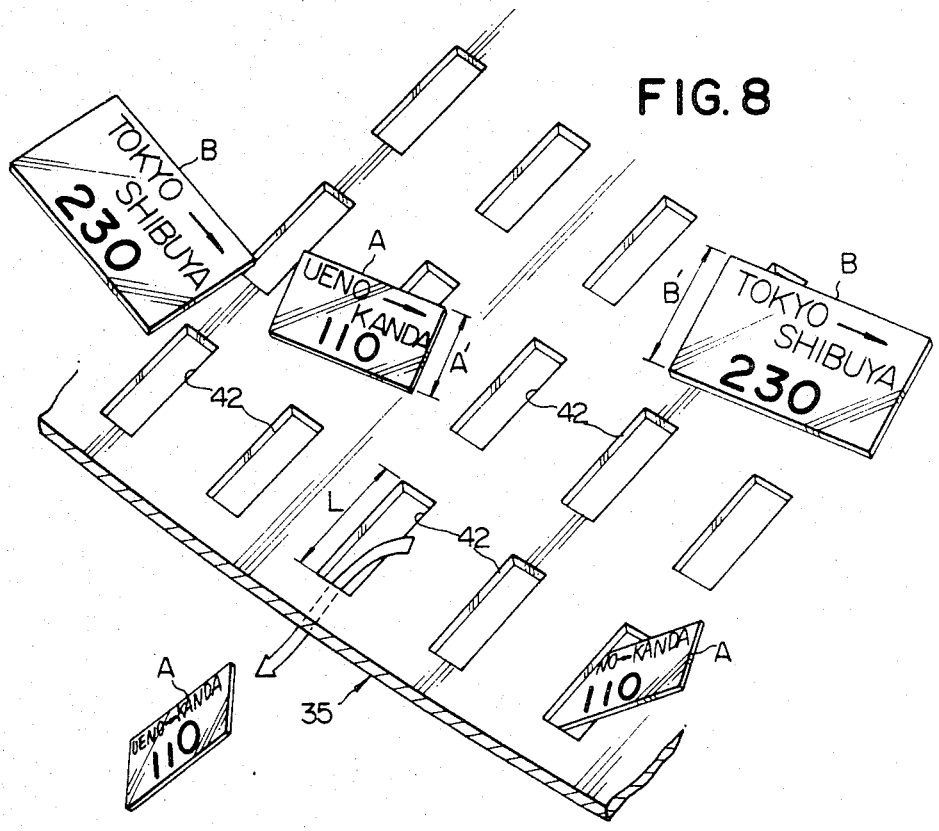
FIG. 8 is an enlarged fragmentary perspective view of the sorter drum shown in FIG. 7.

FIGS. 7 and 8 illustrate a sorter drum 35 according to another embodiment of the present invention. The sorter drum 35 is in the form of a hollow cylindrical wall with one end open and the other end closed and connected concentrically to the drive shaft 11. The sorter drum 35 is rotatably supported by three angularly equidistant support shafts 36, 37, 38 having end and central rollers 39, 40, 41, respectivley, held in rolling engagement with the cylindrical wall. The cylindrical wall has a plurality of rows and columns of rectangular openings 42 defined in and extending radially through the cylindrical wall for passage therethrough of tickets of a particular size. The rows of openings 42 extend axially of the sorter drum 35 at equal intervals and the columns of openings 42 extend circumferentially of the sorter drum 35 at equal intervals, the columns being six in number in the illustrated embodiment. Each of the rectangular openings 42 has its longitudinal axis oriented axially of the sorter drum 35, and has a length L larger than the width A′ of smaller tickets A and smaller than the width B' of larger tickets B, the tickets A, B being differently sized according to their printed fares.

The sorting device with the sorter drum 35 mounted therein will operate as follows: With the tickets A, B placed in the sorter drum 35, the sorter drum 35 is rotated in the direction of the arrow U about its axis by the motor 12. As the sorter drum 35 rotates, the tickets A, B are slid on the inner peripheral surface of the sorter drum 35 and caught at their corners or edges by the openings 42. Because of the limited length L of the openings 42, only the narrower tickets A are allowed to pass through the openings 42, while the wider tickets B are prevented from going therethrough but remain within the sorter drum 35. The tickets A as they are discharged through the openings 42 fall into the collector box. The sorter drum 35 continues to rotate until the motor 12 is de-energized as by a timer switch to stop the sorter drum 35. Then, the collector box is removed to retrieve the tickets A, and the ticket discharger is opened to take out the tickets B from the sorter drum 35.

The arrangement shown in FIGS. 7 and 8 is advantageous in that the tickets A can be sorted out in a relatively short interval of time as there are many openings 42 defined in the sorter drum 35 to catch the tickets A highly efficiently.

Figure 9:
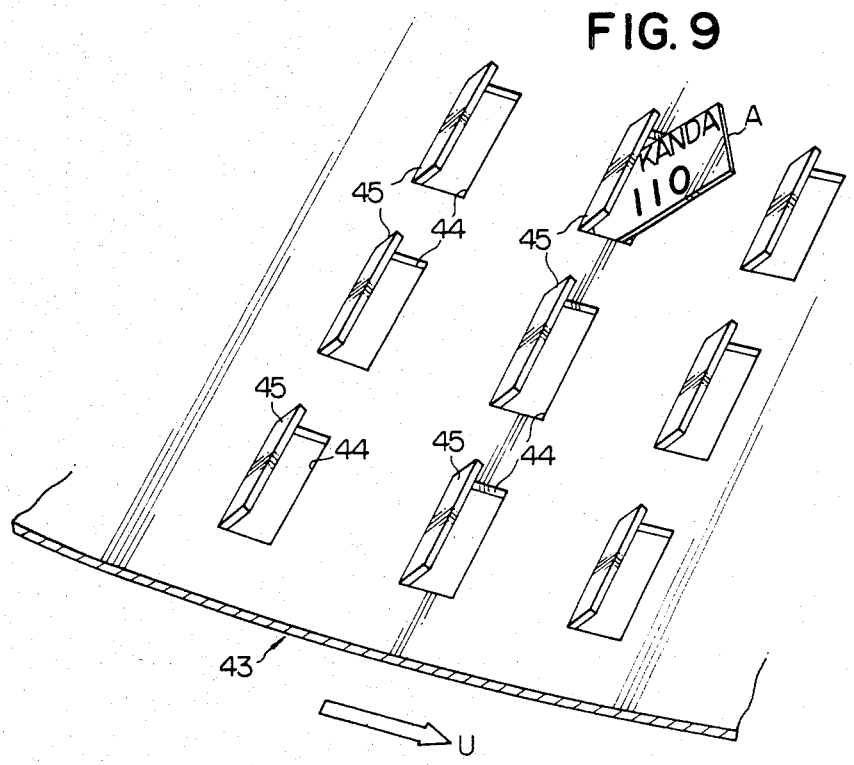
FIG. 9 is an enlarged fragmentary perspective view of a modified sorter drum.

FIG. 9 shows a modified sorter drum 43 having a plurality of rectangular openings 44 arranged in axial rows and circumferential columns, and a plurality of rectangular baffling plates 45 projecting obliquely radially inwardly of the sorter drum 43 in overhanging relation to the openings 44, respectively, and extending longitudinally therealong. When the sorter drum 43 rotates in the direction of the arrow U, tickets A can be caught by the baffling plates 45 and guided thereby into the openings 44 for being discharged therethrough. The baffling plates 45 can be formed by being bent inwardly when the openings 44 are defined in blanking operation.

Figure 10:
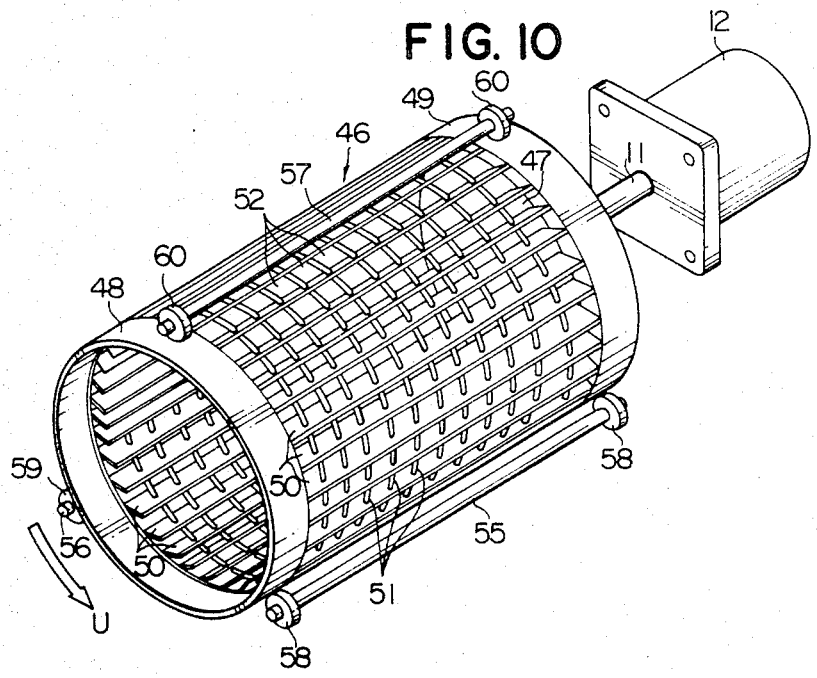
FIG. 10 is a perspective view of a sorter drum according to still another embodiment.
Figure 11:
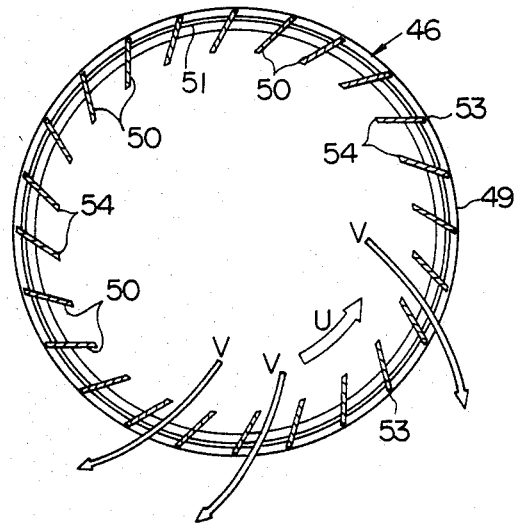
FIG. 11 is a transverse cross-sectional view of the sorter drum illustrated in FIG. 10.
Figure 12:
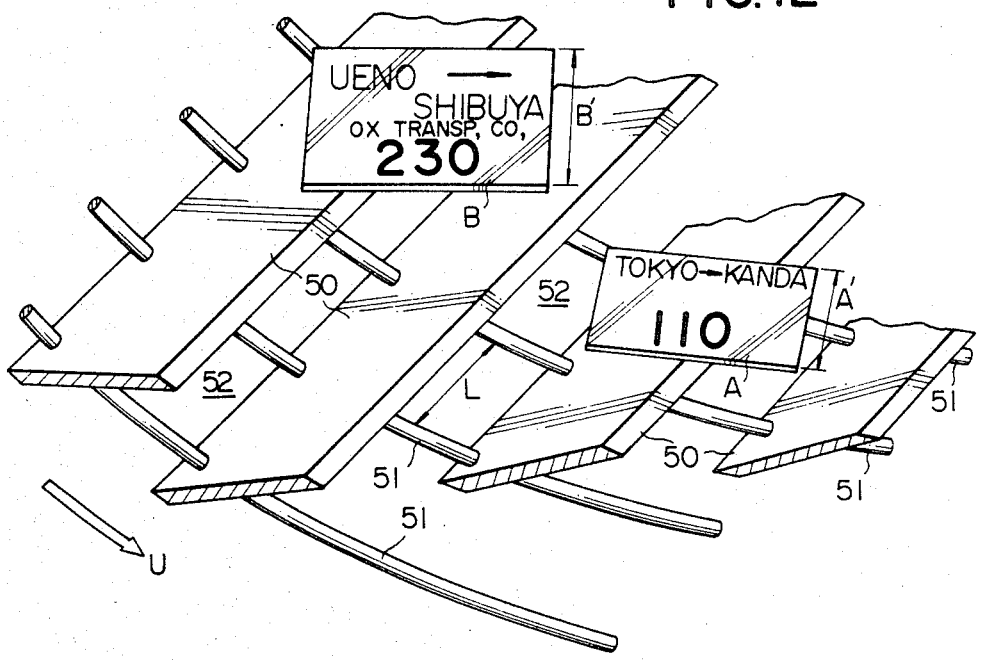
FIG. 12 is an enlarged fragmentary perspective view of the sorter drum shown in FIG. 11.

FIGS. 10 through 12 show a sorter drum 46 according to still another embodiment of the present invention. The sorter drum 46 comprises a cage-shaped cylindrical body having a circular bottom 47 at an axial end thereof to which the drive shaft 11 of the motor 12 is concentrically connected, an end ring 48 defining an open end remote from the bottom 47 in coaxial relation thereto, and an annular flange 49 mounted on the bottom 47 and axially spaced from the end ring 48. The end ring 48 and the bottom 47 with the annular flange 49 are made of thin steel plates and have equal diameters. The sorter drum 46 also includes a plurality of elongate partitions 50 extending axially between the end ring 48 and the annular flange 49 and equally spaced circumferentially of the sorter drum 46, and a plurality of reinforcement rings 51 in the form of thin annular wires extending circumferentially of the sorter drum 46 through apertures (not shown) defined in the elongate partitions 50 and equally spaced axially of the sorter drum 46. The reinforcement rings 51 serve as ticket size limiters that cooperate with the elongate partitions 50 in defining rectangular openings 52 through which tickets of a certain size can pass. As shown in FIG. 11, each of the elongate partitions 50 lies in a plane extending off the central axis of the sorter drum 46 at an angle with respect to the reinforcement rings 51. The reinforcement rings 51 are held in substantially axial alignment with the end ring 48 and the annular flange 49. Each of the elongate partitions 50 has a radially outward longitudinal edge 53 substantially axially aligned with the end ring 48 and the annular flange 49 and a radially inward longitudinal edge 54 positioned radially inwardly of the end ring 48 and the annular flange 49.

The sorter drum 46 is supported horizontally by three support shafts 55, 56, 57 having rollers 58, 59, 60, respectively, which rollingly engage the end ring 48 and the annular flange 49 on their outer circumferential surfaces.

As shown in FIG. 12, adjacent two of the reinforcement rings 51 are spaced from each other by a distance L which is larger than the width A' of a smaller ticket A but smaller than the width B' of a larger ticket B. In operation, when the sorter drum 46 is rotated by the motor 12 with a mixture of tickets A, B stored in the sorter drum 46, the tickets A, B are caused to tumble in the sorter drum 46 and tend to get caught by the partitions 50. At this time, only the tickets A are allowed to pass longitudinally through the rectangular openings 52 defined by the partitions 50 and the reinforcement rings 51, and therefore are discharged in the directions of the arrows V (FIG. 11) out of the sorter drum 46 into the ticket collector box below the sorter drum 46. The larger tickets B remain trapped in the sorter drum 46, and will be collected through the open end of the latter at a later time. The sorter drum 46 as illustrated in FIGS. 10 through 12 is advantageous in that it has more openings for passage therethrough of tickets of a particular dimension, and therefore can sort out a greater number of such tickets in a shorter period of time and hence with a higher efficiency.

Figure 13:
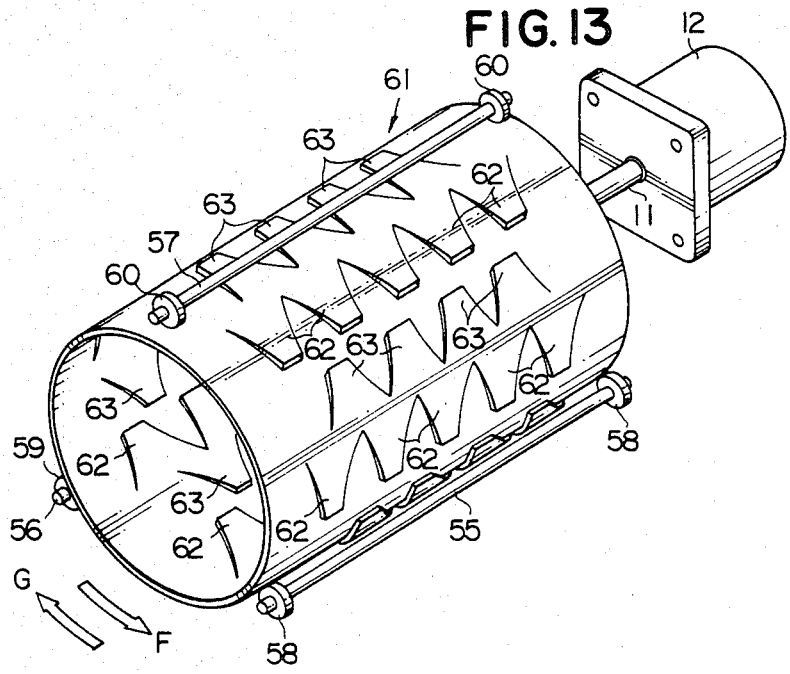
FIG. 13 is a perspective view of a sorter drum according to still another embodiment.
Figure 14:
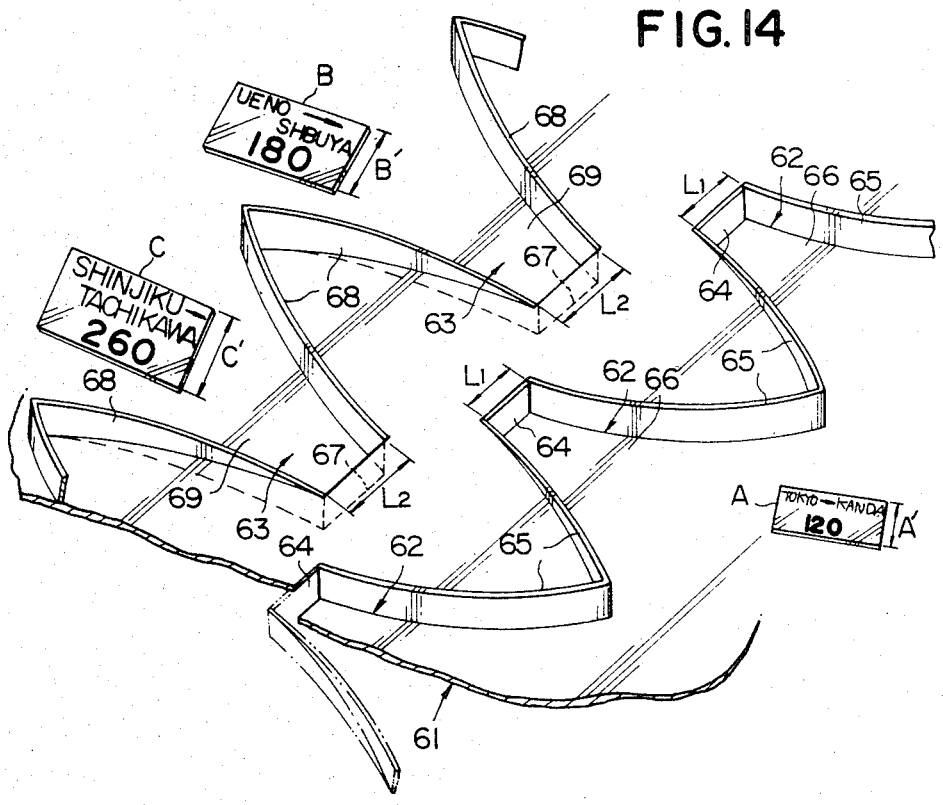
FIG. 14 is an enlarged fragmentary perspective view of the sorter drum shown in FIG. 13.

FIGS. 13 and 14 are illustrative of a sorter drum 61 according to still another embodiment of the present invention. The sorter drum 61 is hollow and has a cylindrical thin metal wall with one end open and the other end closed to which is concentrically connected the drive shaft 11 of the motor 12. The sorter drum 61 has a plurality of first rows of tapered tongues 62 sheared off the cylindrical wall radially outwardly thereof and extending circumferentially of the cylindrical wall, and a plurality of second rows of tapered tongues 63 sheared off the cylindrical wall radially outwardly thereof and extending circumferentially of the cylindrical wall. The first and second rows of tongues 62, 63 alternate in the circumferential direction of the cylindrical wall, and each row of the tapered tongues 62, 63 extends axially of the sorter drum 61. In the illustrated embodiment, the tapered tongues 62 in each first row are five in number, and the tapered tongues 63 in each second row are four in number. As better shown in FIG. 14, each tapered tongue 62 in each first row has a distal end edge displaced radially outwardly off the cylindrical wall to define therewith a rectangular opening 64 having a length L1, and a pair of converging side edges along which extend guide strips 65, respectively, to provide a tapered slide surface 66. Likewise, each tapered tongue 63 in each first row has a distal end edge displaced radially outwardly off the cylindrical wall to define therewith a rectangular opening 67 having a length L2, and a pair of converging side edges along which extend guide strips 68, respectively, to provide a tapered slide surface 69. The length L1 of each opening 64 is smaller than the length L2 of each opening 67 so that the openings 64 can admit tickets A having a smaller width A' and the openings 67 can admit tickets B having a medium width B' larger than the width A', and both of the openings 64, 67 can reject ticket C having a larger width C' larger than the widths A', B'. The openings 64 in each first row are oriented circumferentially of the sorter drum 61 in one direction of rotation thereof, while the openings 67 in each second row are oriented circumferentially of the sorter drum 61 in an opposite direction of rotation thereof. Stated otherwise, the tapered tongues 62 and the tapered tongues 63 are directed circumferentially in opposite directions and axially staggered with respect to each other.

The tickets A, B, C are differently sized according to their printed fares. When the sorter drum 61 is rotated first in the direction of the arrow F by the motor 12 with a mixture of tickets A, B, C contained in the sorter drum 61, the tickets A, B, C are collected by the guide strips 65 onto the tapered slide surfaces 66 toward the openings 64 while the tickets are tumbling and being slid down the inner circumferential surface of the sorter drum 61 due to gravity. Since the openings 64 are of the length L1 larger than the width A' of the tickets A but smaller than the widths B', C' of the tickets B, C, only the tickets A are allowed to pass through the openings 64 out of the sorter drum 61 into the ticket collector box disposed below the sorter drum 61, and the tickets B, C are rejected and remain in the sorter drum 61. After all the tickets A have been discharged out of the sorter drum 61, the motor 12 is de-energized as by a timer switch to stop the sorter drum 61, and the ticket collector box is pulled out to pick up the collected tickets A. The empty ticket collector box is inserted again below the sorter drum 61, and then the motor 12 is turned on to rotate the sorter drum 61 in the direction of the arrow G. The tickets B, C are then collected by the guide strips 68 onto the slide surfaces 69, and only the medium-sized tickets B are discharged through the openings 67 out of the sorter drum 61 into the ticket collector box, while the largest tickets C are prevented from being discharged and remain trapped in the sorter drum 61. After the tickets B have been discharged, the motor 12 is stopped and the tickets B are retrieved from the ticket collector box after it has been pulled out. The tickets C can be picked up from the sorter drum 61 through the open end thereof. With the embodiment of FIGS. 13 and 14, tickets of different sizes can be sorted out automatically in a short period of time by rotating the sorter drum 61 in opposite directions.

Figure 15:
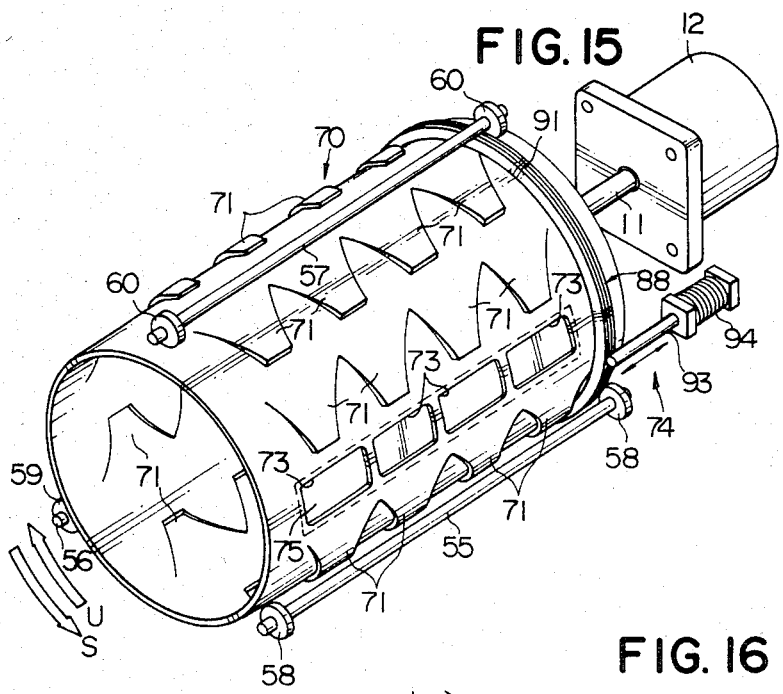
FIG. 15 is a perspective view of a sorter drum according to a still further embodiment.
Figure 16:
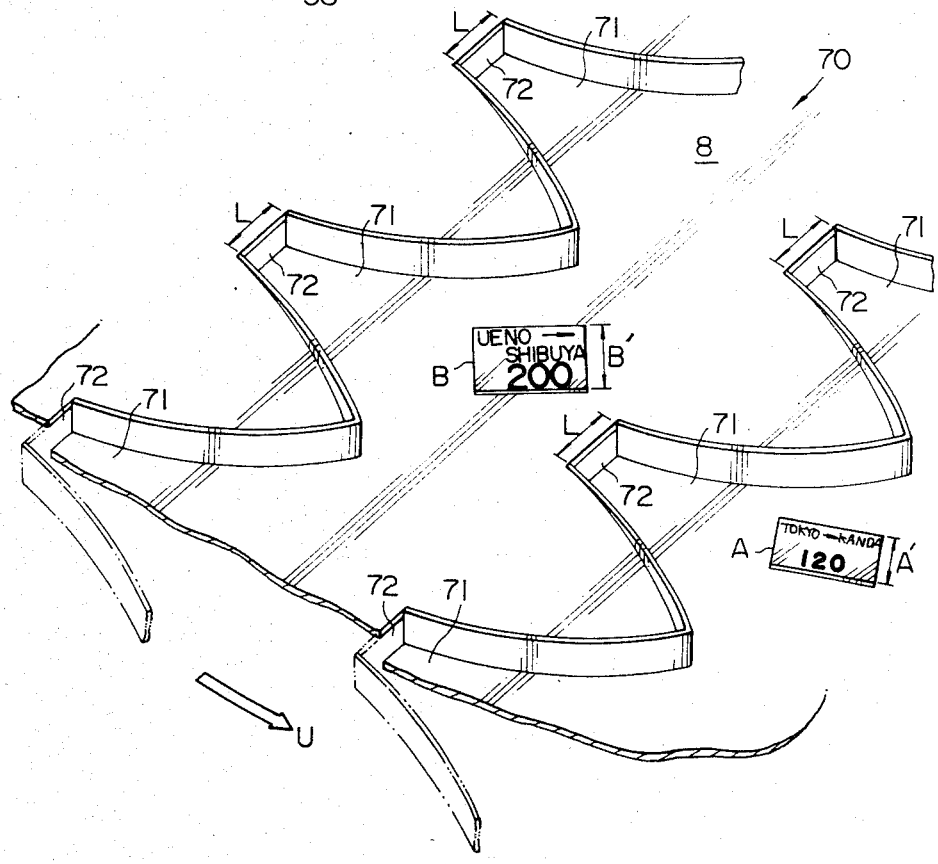
FIG. 16 is an enlarged fragmentary perspective view of the sorter drum shown in FIG. 15.
Figure 17:
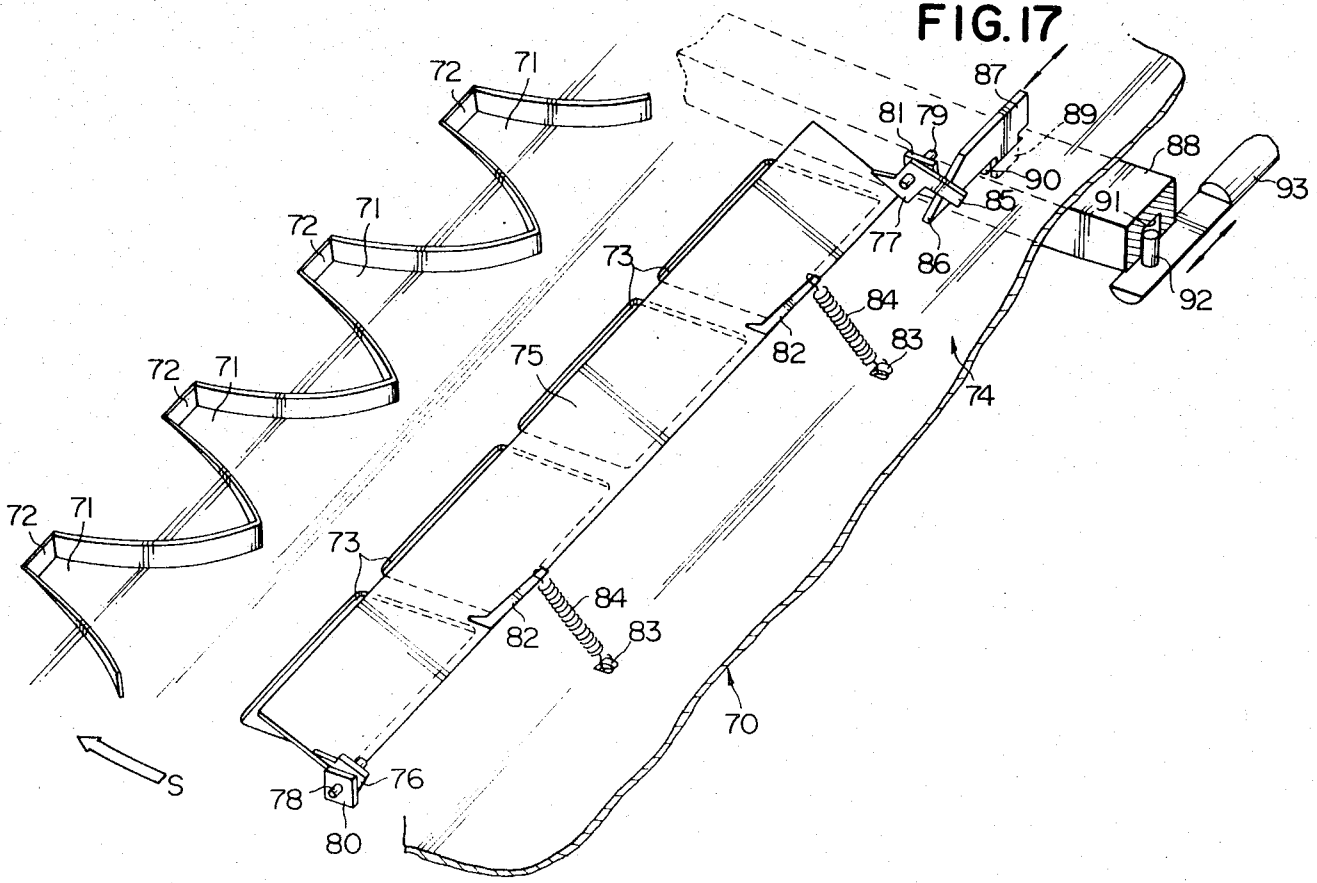
FIG. 17 is an enlarged fragmentary perspective view of the sorter drum shown in FIG. 15, the view being illustrative of a mechanism for opening and closing discharge holes.

According to a still further embodiment illustrated in FIGS. 15 through 17, a sorter drum 70 is in the form of a cylindrical wall having a plurality of rows of tapered tongues 71 which are of the same construction as that of the tapered tongues 17 shown in FIG. 3 and which define rectangular openings 72 for passage therethrough of tickets A of a smaller size, as illustrated in FIG. 16. The sorter drum 70 additionally has a row of rectangular discharge holes 73 defined in the cylindrical wall and arranged axially thereof, and a mechanism 74 mounted on the cylindrical wall for opening and closing the discharge openings 73. The sorter drum 70 is designed to sort out tickets A, B (FIG. 16) of different sizes. The rectangular openings 72 have a length L larger than the width A' of the tickets A but smaller than the width B' of the tickets B, so that the openings 72 allow only the tickets A to pass therethrough. The rectangular discharge holes 73 are dimensioned to pass the tickets B therethrough when the discharge holes 73 are opened by the mechanism 74.

As shown in FIG. 17, the mechanism 74 comprises an elongate cover 75 pivotably mounted on the cylindrical wall over the discharge holes 73 and having a pair of end supports 76, 77 having pins 78, 79, respectively, journalled in bearing members 80, 81, respectively, disposed on the cylindrical wall. The cover 75 also has a pair of spaced arms 82, 82 coupled to hooks 83, 83, respectively, on the cylindrical wall by springs 84, 84 which normally urge the cover 75 in a direction to open the discharge holes 73. The support 77 includes a cam follower 85 held in slidable engagement with a slanted surface 86 of a cam 87. An annular control member 88 is disposed around the cylindrical wall and supports thereon the cam 87, which has a connector 89 extending through a slot 90 defined in the cylindrical wall. The annular control member 88 has a groove 91 opening radially outwardly and receiving slidably therein a pin 92 projecting from a rod 93 extending in the axial direction of the sorter drum 70 from a solenoid 94 disposed adjacent to the motor 12.

To sort out the tickets A, B stored in the sorter drum 70, the sorter drum 70 is rotated by the motor 12 in the direction of the arrow U to collect the tickets A, B onto the tapered tongues 71. At this time, the solenoid 94 remains de-energized to extend the rod 93 for thereby displace the annular control member 88 axially away from the solenoid 94 until the cam 87 causes the cam follower 85 to move upwardly as shown in FIG. 17. Therefore, the cover 75 is lowered into engagement with the inner circumferential surface of the sorter drum 70, closing the discharge openings 73. No tickets are allowed to pass through the discharge openings 73. The rotation of the sorter drum 70 forces the tickets A, B toward the openings 72, but only the tickets A of a smaller dimension are permitted to be discharged through the openings 72 with the larger tickets B prevented from passing through the openings 72.

The discharged tickets A are collected in the ticket collector box, which is then pulled out for ticket retrieval after the motor 12 has been turned off to stop the sorter drum 70. The tickets B which remain within the sorter drum 70 can be collected from the latter by placing the empty ticket collector box below the sorter drum 70, energizing the solenoid 94 to pull the rod 93 and hence the annular control member 88 for allowing the cam follower 85 to slide down the cam 87 as it is retracted, for thereby erecting the cover 75 radially inwardly into the sorter drum 70 to uncover the discharge openings 73 under the resiliency of the springs 84, and rotating the sorter drum 70 with the motor 12 in the direction of the arrow S which is opposite to the direction of the arrow U. The tickets B are then discharged through the discharge openings 73 out of the sorter drum 70 into the ticket collector box. Thereafter, the sorter drum 70 is stopped and the ticket collector box is withdrawn to retrieve the collected tickets B therefrom.

Figure 18:
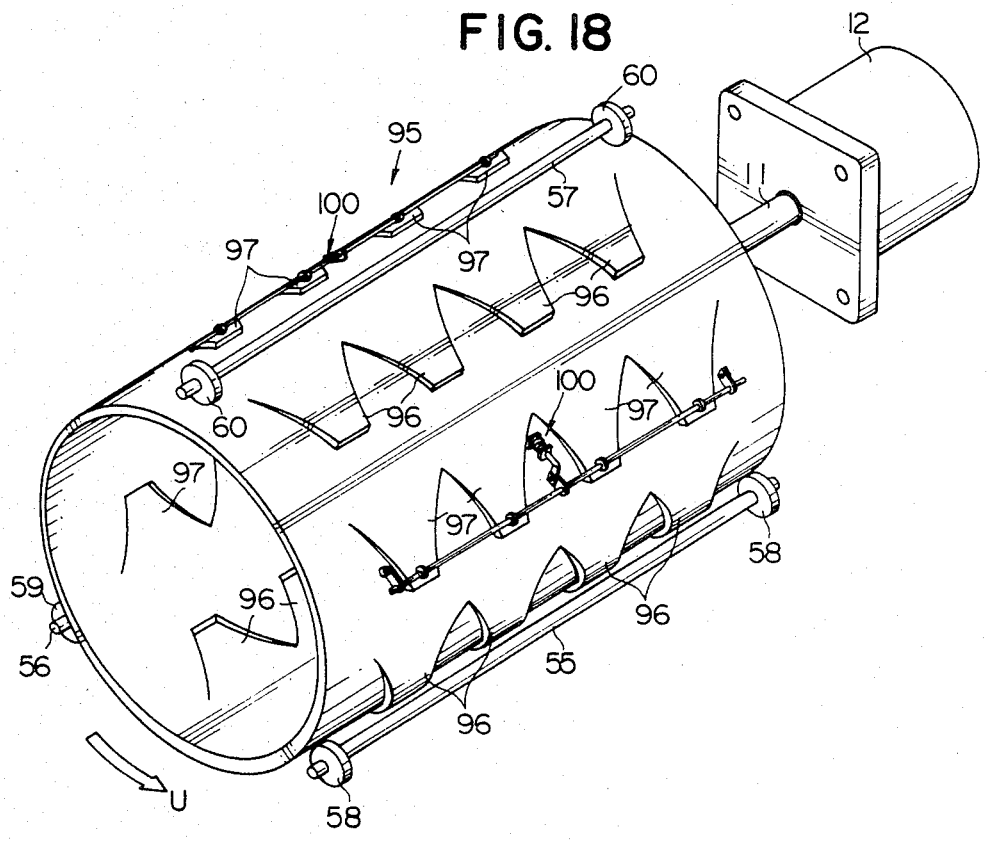
FIG. 18 is a perspective view of a sorter drum according to a still further embodiment.
Figure 19:
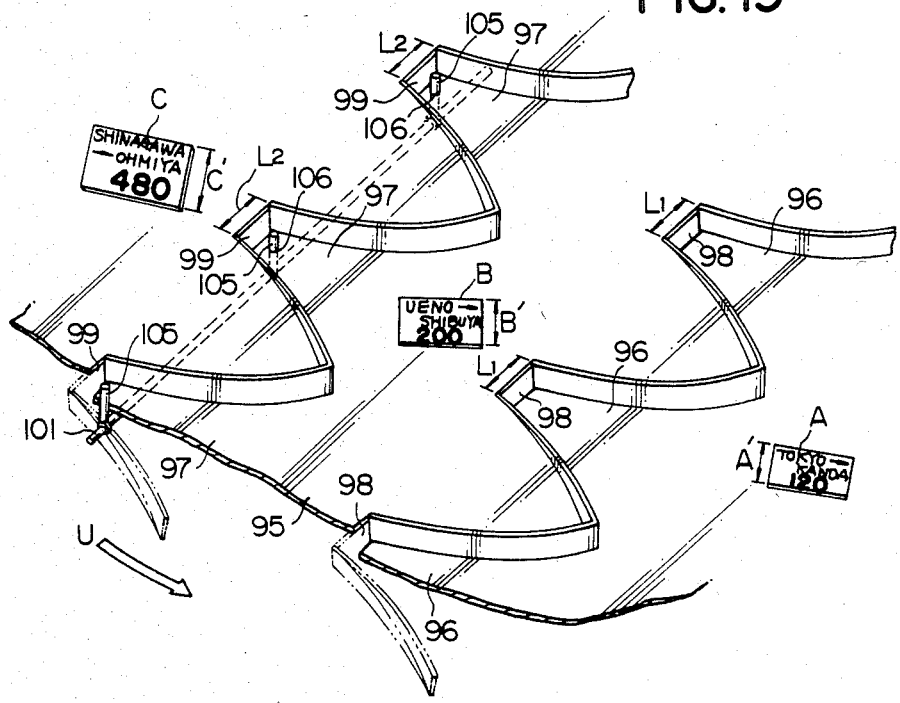
FIG. 19 is an enlarged fragmentary perspective view of the sorter drum illustrated in FIG. 18.
Figure 20:
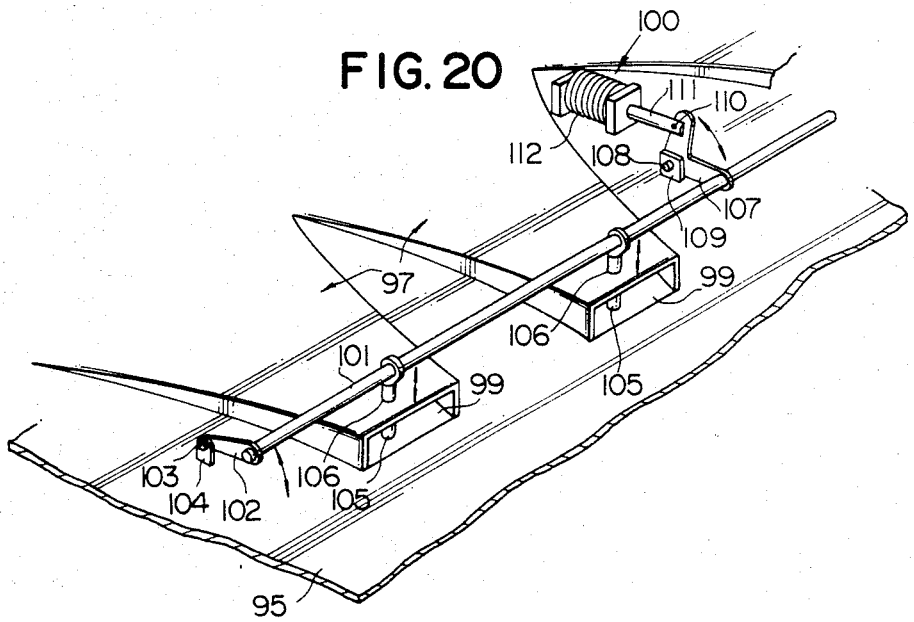
FIG. 20 is an enlarged fragmentary perspective view of the sorter drum of FIG. 18, showing a discharge control mechanism.

FIGS. 18 through 20 shows a sorter drum 95 constructed in accordance with a still further embodiment of the present invention. The sorter drum 95 comprises a cylindrical wall including an open end and a closed end coupled to the drive shaft 11 of the motor 12. The sorter drum 95 has a plurality of first rows of tapered tongues 96 and a plurality of second rows of tapered tongues 97 alternating circumferentially with the first rows of tapered tongues 96. The first and second rows of tapered tongues 96, 97 extend axially of the sorter drum 95. In the illustrated embodiment, the tapered tongues in each row are four in number. The tapered tongues 96, 97 are substantially the same in construction as the tapered tongues 17 as shown in FIGS. 15, 16, 17 except that the tapered tongues 96 define rectantular openings 98 and the tapered tongues 97 define rectangular openings 99 larger than the rectangular openings 98. The tapered tongues 96, 97 in each row extend circumferentially in the same direction, that is, the openings 98, 99 are oriented in one direction of rotation of the sorter drum 95. Each rectangular opening 98 has a length L1 greater than the width A′ of smallest tickets A to be sorted out but smaller than the width B′ of the tickets B, and each rectangular opening 99 has a length L2 larger than the width B′ of medium tickets B sorted out but smaller than the width C′ of largest tickets C.

The sorter drum 95 also has a discharge control mechanism 100 associated with each of the second rows of tapered tongues 97 and disposed on the outer circumferential surface of the cylindrical wall for selectively preventing passage of the tickets B through the openings 99. The discharge control mechanism 100 comprises, as better shown in FIG. 20, a control rod 101 pivotably supported on the cylindrical wall and extending axially thereof along the second row of tapered tongues 97, the control rod 101 having end arms 102 which are pivotably connected by pins 103 to supports 104 mounted on the cylindrical wall. A plurality of control pins 105 are mounted on the control rod 101 at spaced intervals therealong and extending through apertures 106 defined in the tapered tongues 97 in a direction centrally across the openings 99. The control rod 101 is centrally connected to one arm of an L-shaped lever 107 having at a central portion thereof a pivot pin 108 journalled on a support 109 mounted on the cylindrical wall. The other arm of the L-shaped lever 107 is pivotably coupled by a pin 110 to a rod 111 of a solenoid 112 installed on the cylindrical wall of the sorter drum 95 between adjacent two of the tapered tongues 97.

When the tickets A, B, C are to be sorted out, they are placed in the sorter drum 95 and then the latter is driven by the motor 12 to rotate about its own axis in the direction of the arrow U. At this time, the solenoid 112 remain de-energized to let the control pins 105 project across the openings 99. The tickets A, B, C are caused to tumble and slide down as they are collected onto the tapered tongues 96, 97. Since the openings 98 are dimensioned to admit the tickets A only, the tickets A are allowed to pass through the openings 98 while the tickets B, C are prevented from being discharged out. The openings 99 are closed by the control pins 105 which reject the tickets A, B. The discharged tickets A are received in the ticket collector box located below the sorter drum 95. After all the tickets A have been collected, the motor 12 is turned off as by a timer switch to stop the sorter drum 95, and the ticket collector box is pulled out to retrieve the tickets A. The empty ticket collector box is placed below the sorter drum 95, and the motor 12 is energized again to rotate the sorter drum 95 in the direction of the arrow U. Simultaneously, the solenoid 112 is energized to retract the rod 111 for thereby causing the L-shaped lever 107 to move the control rod 101 away from the sorter drum 95 until the control pins 105 are lifted clear out of the openings 99. With the openings 99 open, the tickets B are permitted to be discharged therethrough out of the sorter drum 95 into the ticket collector box, leaving only the tickets C in the sorter drum 95. When the tickets B have completely been collected, the motor 12 is turned off again, and the ticket collector box is removed again in order to pick up the tickets B therefrom. The tickets C can then be taken out of the sorter drum 95 through its open end.

Although certain preferred embodiments have been shown and described, it should be understood that many changes and modifications may be made therein without departing from the scope of the appended claims.

What is claimed is:

1. A device for sorting out a multiplicity of pieces according to their size, comprising:

a frame;

a drum rotatably mounted in said frame for storing therein pieces having different sizes to be sorted out, said drum having a clyindrical wall;

means on said drum including openings for passing therethrough pieces of a particular size only, said passing means comprising a plurality of rows of tapered tongues sheared off said cylindrical wall radially outwardly thereof and extending circumferentially of said cylindrical wall, each row of said tapered tongues extending axially of said drum, said tapered tongues terminating respectively in said openings and being progressively narrower toward said openings for guiding the pieces of a particular size toward said opening, said tapering tongues further having an end edge and a pair of converging side edges extending from said cylindrical wall to said end edge, said end edge being displaced radially outwardly from said cylindrical wall to define therewith one of said openings and said passing means further includes guiding guide strips each extending along one of said said edges toward said opening to provide tapered guide passages respectively on said tapered tongues; and means for rotating said drum about its own axis to cause the pieces of a particular size to be discharged through said openings out of said drum.

2. A device for sorting out a multiplicity of pieces according to their size, comprising:

a frame;

a drum rotatably mounted in said frame for storing therein pieces having different sizes to be sorted out, said drum comprising a cylindrical body having one end closed, said drum further having an open axial end axially opposite said closed end, said frame having an opening held in registry with said open axial end of said drum;

means on said drum including openings for passing therethrough pieces of a particular size only;

a charger pivotally mounted on said frame and having a chute for charging the pieces down said chute through said opening and open axial end into said drum, said charger being angularly movable between a first position in which said charger covers said opening with said chute projecting into said drum through said opening and open axial end and a second position in which said chute is displaced out of said drum with said opening being exposed; and means for rotating said drum about its own axis to cause the pieces of a particular size to be discharged through said openings out of said drum, said rotating means comprising a motor having a drive shaft connected concentrically to said closed end of said cylindrical body.

3. A device according to claim 2, including a plurality of support shafts extending axially parallel to said cylindrical body and spaced radially from each other, each of said support shafts having a plurality of rollers held in rolling engagement with said cylindrical body.

4. A device according to claim 2, wherein said drum has an annular plate disposed therein slightly off said open end and having a central circular hole, said chute projecting into said central circular hole when said charger is in said first position.

5. A device for sorting out a multiplicity of pieces according to their size, comprising:

a frame;

a drum rotatably mounted in said frame and having a cylindrical wall for storing therein pieces having different sizes to be sorted out;

a plurality of rows of tapered tongues having an end edge and a pair of side edges, said end and side edges being sheared off said cylindrical wall radially outwardly thereof, said tapered tongues extending circumferentially of said cylindrical wall, each row of said tapered tongues extending axially of said drum, the end edges of said tapered tongues and said cylindrical wall jointly defining openings therebetween for passing therethrough pieces of a particular size only, said tapered tongues being progressively narrower toward said openings, providing substantially flat tapered slide surfaces for guiding the pieces of the particular size toward said openings; and means for rotating said drum about it own axis to cause the pieces of the particular size to be discharged through said openings out of said drum.

6. A device for sorting out a multiplicity of pieces according to their size, comprising:

a frame;

a drum rotatably mounted in said frame and having a cylindrical body for storing therein pieces having different sizes to be sorted out, said cylindrical body having one end closed and a cylindrical wall having a plurality of substantially flat slide surfaces tapered toward end edges thereof which are displaced radially outwardly from said cylindrical wall, said end edges and said cylindrical wall jointly defining openings therebetween which open radially outwardly of said cylindrical wall in one circumferential direction of said cylindrical wall; and a motor having a drive shaft connected concentrically to said closed end of said cylindrical body for rotating said drum about its own axis in a direction opposite to said one circumferential direction to cause pieces of a particular size to be discharged through said openings out of said drum.

* * * * *